United States Patent [19]

Adams et al.

[11] 4,456,491

[45] Jun. 26, 1984

[54] METHOD OF HOT-FORMING METALS PRONE TO CRACK DURING ROLLING

[75] Inventors: Ronald D. Adams; E. Henry Chia, both of Carrollton, Ga.

[73] Assignee: Southwire Company, Carrollton, Ga.

[21] Appl. No.: 241,788

[22] Filed: Mar. 9, 1981

Related U.S. Application Data

[63] Continuation-in-part of Ser. No. 80,368, Oct. 1, 1979, Pat. No. 4,352,697.

[51] Int. Cl.[3] ..... C22F 1/04

[52] U.S. Cl. ..... 148/2; 148/11.5 A

[58] Field of Search ..... 148/2, 11.5 A; 164/476

[56] References Cited

U.S. PATENT DOCUMENTS

| | | | |
|---|---|---|---|
| 3,680,623 | 8/1972 | Tarmann et al. | 164/476 |
| 3,710,841 | 1/1973 | Baumann | 164/476 |
| 4,003,236 | 1/1977 | Quehen | 164/476 |
| 4,151,896 | 5/1979 | Nicoud et al. | 148/11.5 A |
| 4,177,085 | 12/1979 | Chadwick et al. | 148/2 |
| 4,234,359 | 11/1980 | Chia et al. | 148/11.5 A |
| 4,352,697 | 10/1982 | Adams et al. | 148/2 |

FOREIGN PATENT DOCUMENTS

| | | | |
|---|---|---|---|
| 49930 | 4/1979 | Japan | 164/476 |

*Primary Examiner*—Peter K. Skiff

*Attorney, Agent, or Firm*—Herbert M. Hanegan; Robert S. Linne; Michael C. Smith

[57] ABSTRACT

A method of continuously casting a molten metal in a casting means to obtain a solidified cast bar at a hot-forming temperature, passing the cast metal at a hot-forming temperature from the casting means to a hot-forming means, and hot forming the cast bar into a wrought product by a two-stage reduction of its cross-sectional area while it is still at a hot-forming temperature, including, in the first stage, the step of forming a substantially uniform subgrain or cell structure in the outer surface layers of the cast bar by a selected small amount of deformation of the cast bar in its as-cast condition prior to the second stage in which substantial reduction of its cross-sectional area forms the wrought product. The substantially uniform subgrain structure formed on the cast bar during the first stage of deformation produces a bar that has increased ductility compared to bar produced by the prior art processes and permits substantial reduction of the cross-sectional area of the cast bar during the second stage of deformation without the cast bar cracking, even when the cast bar has a relatively high percentage of alloying elements present.

22 Claims, 7 Drawing Figures

METHOD OF HOT-FORMING METALS PRONE TO CRACK DURING ROLLING

CROSS REFERENCE TO RELATED APPLICATION

This application is a continuation-in-part of co-pending application Ser. No. 80,368, filed Oct. 1, 1979, now U.S. Pat. No. 4,352,697.

BACKGROUND OF THE INVENTION

The present invention relates to the hot forming of metals, and more particularly relates to the continuous casting and hot forming of the as-cast bars of certain impure or alloyed metal prone to crack during hot-rolling.

It is well known that metals, such as aluminum and aluminum alloys, may be continuously cast, either in stationary vertical molds or in a rotating casting wheel, to obtain a cast bar which is then immediately hot formed, while in a substantially as-cast condition, by passing the cast bar exiting the mold to and through the roll stands of a rolling mill while the cast bar is still at a hot-forming temperature. It is also well known that the as-cast structure of the metal bar is such that cracking of the cast bar during hot forming may be a problem if the cast bar is required to be directly hot formed into a semi-finished product, such as redraw rod, during which the initially large cross-sectional area of the cast bar is substantially reduced by a plurality of deformations along different axes to provide a much smaller cross-sectional area in the product.

While this problem could be avoided by casting a cast bar having an initially small cross-sectional area which need not be substantially reduced to provide the desired cross-sectional area of the final product, this approach is not commercially practical since high casting outputs, and therefore low costs, can be readily achieved only with cast bars having large cross-sectional areas which are rapidly reduced to the smaller cross-sectional areas of the products, such as $\frac{3}{8}''$ diameter rod for drawing into wire, by a minimum number of severe deformations. Thus, the problem of a cast bar cracking during hot forming must be solved within the commercial context of cast bars having initially large cross-sectional areas which are then hot formed into products having small cross-sectional areas by a series of reductions which often are substantial enough to cause cracking of the cast bar under certain conditions.

For example, U.S. Pat. No. 3,317,994, and U.S. Pat. No. 3,672,430 disclose that this cracking problem can be overcome in copper by conditioning relatively pure copper cast bar by initial large reductions of the cross-sectional area in the initial roll stands sufficient to substantially destroy the as-cast structure of the cast bar. The additional reductions along different axes of deformation, which would cause cracking of the cast bar but for the initial destruction of the as-cast structure of the cast bar, may then safely be performed. This conditioning of the cast bar not only prevents cracking of the cast bar during hot forming but also has the advantage of accomplishing a large reduction in the cross-sectional area of the cast bar while its hot-forming temperature is such as to minimize the power required for the reduction.

The prior art has not, however, provided a solution to the cracking problem described above for metals, such as aluminum, containing a relatively high percentage of alloying elements. This is because the large amounts of alloying element in the grain boundaries of the as-cast structure cause the cast bar to crack when an attempt is made to substantially destroy the as-cast structure with the same large initial reduction of the cross-sectional area of the cast bar that is known to be effective with relatively pure metal. Moreover, the greater the percentage of alloying elements in the cast bar, the more likely it is that cracks will occur during hot forming.

SUMMARY OF THE INVENTION

The present invention solves the above-described cracking problem of the prior art by providing a method of continuously casting and hot forming both low and high alloy percentage aluminum without substantial cracking of the cast bar occurring during the hot rolling process. Generally described, the invention provides, in a method of continuously casting molten metal to obtain a cast bar, which may have columnar or equiaxed structure produced by any known method, with a relatively large cross-sectional area, and hot forming the cast bar at a hot-forming temperature into a product having a relatively small cross-sectional area by a substantial reduction of the cross-sectional area of the cast bar which would be such that the as-cast structure of the cast bar would be expected to cause the cast bar to crack, the additional step of first forming a substantially uniform subgrain structure at least in the surface layers of the cast bar prior to later substantial reduction of the cross-sectional area of the cast bar, said substantially uniform subgrain structure being formed by relatively light deformations of the cast bar while at a hot-forming temperature.

Aluminum and its alloys, due to their high stacking fault energy, form cells or subgrains during hot deformation. This is due to the arrangement of the dislocations as they interact with each other and with second phase particles present in the aluminum matrix. In contrast, grains are separated by high angle boundaries and are formed during the solidification of the cast bar which contain the solidified dendritic structure.

The light deformations are of magnitude (preferably 5 to 25%) which will not cause the cast bar to crack, but which in combination with the hot-forming temperature of the cast bar will cause the cast bar to have a substantially uniform subgrain or cell structure of a thickness sufficient (about 10% of total area) to produce a bar of increased ductility when compared to a bar produced by the prior art process, which substantially inhibits the initiation of micro and macro cracking that normally begin at the as-cast grain boundaries, thus preventing cracking of the cast bar (even when having relatively high percentage alloying elements) during the subsequent substantial deformations. The substantially uniform subgrain structure of the surface provided by this invention allows substantial reduction of the cross-sectional area of the bar in a subsequent pass, even in excess of 30%, without cracking occurring and even though the cast bar has a relatively high amount of impurities or alloying elements.

For example, the present invention allows an aluminum alloy cast bar having a cross-sectional area of 5 square inches, or more to be continuously hot formed into wrought rod having a cross-section area of $\frac{1}{2}$ square inch, or less, without cracking.

Furthermore, the invention has wide general utility since it can also be used with certain other relatively impure or alloyed metals as an alternative to the solution to the problem of cracking described in U.S. Pat. No. 3,317,994, and U.S. Pat. No. 3,672,430.

Thus, it is an object of the present invention to provide an improved method of continuously casting a molten metal to obtain a cast bar and continuously hot forming the cast bar into a product having a cross-sectional area substantially less than that of the cast bar without cracking of the cast bar occurring during hot forming.

It is a further object of the present invention to provide a method of continuously casting and hot-forming metal containing a relatively high percentage of alloying elements without using specially shaped reduction rolls in the hot-rolling mill or other complex rolling procedures.

It is a further object of the present invention to provide a method whereby a cast bar may be efficiently hot-formed using fewer roll stands following conditioning of the cast metal by first forming a substantially uniform subgrain structure at the surface of the cast metal, then hot rolling the modified structure by successive heavy deformations.

Further objects, features and advantages of the present invention will become apparent upon reading the following specification when taken in conjunction with the accompanying drawing.

DESCRIPTION OF THE PREFERRED EMBODIMENTS

Figure 1:
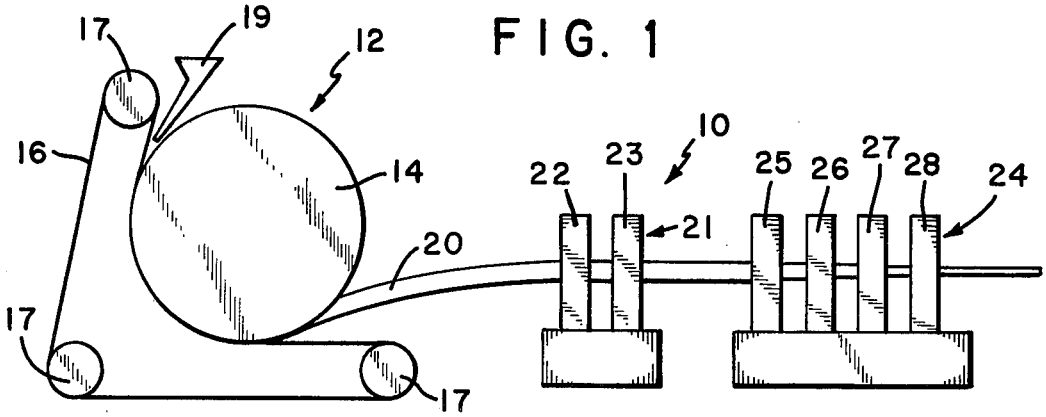
FIG. 1 is a schematic representation of casting and forming apparatus for practicing the method of the present invention.

Referring now to the drawing, in which like numerals refer to like parts throughout the several views, FIG. 1 schematically depicts an apparatus for practicing the method of the present invention. The continuous casting and hot-forming system (10) includes a casting machine (12) which includes a casting wheel (14) having a peripheral groove therein, a flexible band (16) carried by a plurality of guide wheels (17) which bias the flexible band (16) against the casting wheel (14) for a portion of the circumference of the casting wheel (14) to cover the peripheral groove and form a mold between the band (16) and the casting wheel (14). As molten metal is poured into the mold through the pouring spout (19), the casting wheel (14) is rotated and the band (16) moves with the casting wheel (14) to form a moving mold. A cooling system (not shown) within the casting machine (12) causes the molten metal to solidify in the mold and to exit the casting wheel (14) as a solid cast bar (20).

From the casting machine (12), the cast bar (20) passes through a conditioning means (21), which includes roll stands (22) and (23). The conditioning roll stands (22) and (23) lightly compress the bar to form a substantially uniform subgrain structure at the surface of the bar (20). After the conditioning stage (which may be several passes), the bar (20) is passed through a conventional rolling mill (24), which includes roll stands (25), (26), (27) and (28). The roll stands of the rolling mill (24) provide the primary hot forming of the cast bar by compressing the conditioned bar sequentially until the bar is reduced to a desired cross-sectional size and shape.

Figure 2:
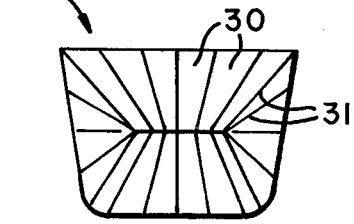
FIG. 2 is a cross-section of a cast bar in substantially an as-cast condition (in this case columnar).

The grain structure of the cast bar (20) as it exits from the casting machine (12) is shown in FIG. 2. The molten metal solidifies in the casting machine in a fashion that can be columnar, or equiaxed, or both, depending on the cooling rate. This as-cast structure can be characterized by grains (30) extending radially from the surfaces of the bar (if columnar) and separated from each other by grain boundaries (31). Most of the alloying elements present in the cast bar are located along the grain and dendrite boundaries (31). If the molten aluminum alloy poured through the spout (19) into the casting wheel (14) were cooled and the cast bar (20) was passed immediately to the rolling mill (24) without passing through the conditioning means (21), the impurities along the boundaries (31) of the cast bar (20) would usually cause the cast bar to crack at the boundaries upon deformation by the roll stands of the rolling mill (24).

Figure 3:
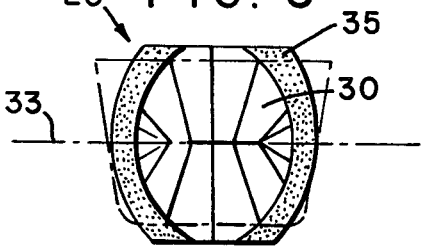
FIG. 3 is a cross-section of the cast bar shown in FIG. 2 following one light reduction of the cross-section.
Figure 2A:
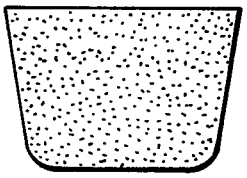
FIG. 2A is a cross-section of a cast bar in substantially an as-cast condition (in the case equiaxed).
Figure 3A:
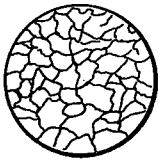
FIG. 3A is a magnification of 2000× of the subgrain or cell structure, a portion of which is shown in FIG. 3.
Figure 4:
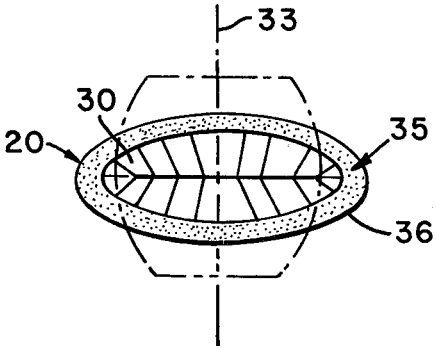
FIG. 4 is a cross-section of the cast bar shown in FIG. 2 following two perpendicular light compressions to form a complete shell of subgrains near the surface of the bar.

The conditioning means (21) prevents such cracking by providing a sequence of preliminary light compressions as shown in FIG. 3 and FIG. 4, wherein the result of a compression is shown and the previous shape of the cast bar is shown in broken lines. FIG. 3 shows the result of a 7% reduction provided by the roll stand (22) along a horizontal axis of compression (33). The columnar and/or equiaxed as-cast grain structures of the cast metal has been formed into a layer of substantially uniform subgrain structure (35) covering a portion of the surface of the cast bar (20). The interior of the bar may still have an as-cast structure.

In FIG. 4 the bar (20) has been subjected to a second 7% reduction by the roll stand (23) along a vertical axis of compression (33) perpendicular to the axis of compression of roll stand (22). The volume of substantially uniform subgrain structure (35) now forms a shell (36) around the entire surface of the bar (20), although the interior of the bar retains some as-cast structure.

It will be understood that the formation of the shell may be accomplished by a conditioning means comprising any number of roll stands, preferably at least two, or any other type of forming tools, such as extrusion dies, multiple forging hammers, etc., so long as the preliminary light deformation of the metal results in a substantially uniform subgrain structure covering substantially the entire surface of the bar, or at least the areas subject to cracking.

The individual light compressions should be between 5–25% reduction so as not to crack the bar during conditioning. The total deformation provided by the conditioning means (21) must provide a shell (36) of sufficient depth (at least about 10%) to prevent cracking of the bar during subsequent deformation of the bar when passing through the roll stands (25–28) of the rolling mill (24).

When the shape of the bar in its as-cast condition includes prominent corners such as those of the bar shown in FIG. 2, the shape of the compressing surfaces in the roll stands (22) and (23) may be designed to avoid excessive compression of the corner areas as compared to the other surfaces of the cast bar, so that cracking will not result at the corners.

Figure 5:
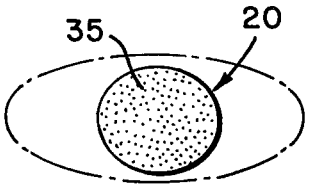
FIG. 5 is a cross-section of the cast bar shown in FIG. 2 following two light compressions and one severe hot-forming compression.

FIG. 5 shows a cross-section (20) following a substantial reduction of the cross-sectional area by the first roll stand (25) of the rolling mill (24). The remaining as-cast structure in the interior of the bar (20) has been transformed into a uniform subgrain structure (35).

When a shell (36) has been formed on the surface of the bar (20), a high reduction may be taken at the first roll stand (25) of the rolling mill (24). It has been found that such initial hot-forming compression may be in excess of 30% following conditioning according to the present invention. The ability to use very high reductions during subsequent hot-forming means that the desired final cross-sectional size and shape may be reached using a rolling mill having a few roll stands. Thus, even though a conditioning means according to the present invention requires one or more roll stands, the total amount and therefore cost of the conditioning and hot-forming apparatus may be reduced.

The method of the present invention allows continuous casting and rolling of relatively high percentage alloy aluminum, such as the 2000, 5000, 6000 and 7000 series aluminum alloys without cracking the bar. Advantageously the following aluminum alloys can be processed according to the present invention: 2024, 2117, 7075, 7079, 6061, 6101, 6201, Almelec, Aldrey Simalec, 5052 and 5056. Furthermore, cracking is prevented throughout the hot-forming temperature range of the metal. Thus, the same casting and hot-forming apparatus may be used to produce aluminum alloys of varying purities and alloying elements depending on the standards which must be met for a particular product.

If it is desired to reduce even further the possibility of cracking, elliptically shaped rolling channels may be provided for all of the roll stands (22), (23), and (25–28) in order to provide optimal tangetial velocities of the rolls in the roll stands with respect to the cast metal, as disclosed in U.S. Pat. No. 3,317,994. However, such measures are usually not needed to avoid cracking if the present invention is practiced as described herein on metals having alloy levels as described above.

It will be understood by those skilled in the art that the roll stands of the conditioning means (21) may be either a separate component of the system or may be constructed as an integral part of a rolling mill.

While this invention has been described in detail with particular reference to preferred embodiments thereof, it will be understood that variations and modifications can be effected within the spirit and scope of the invention as described herein before and as defined in the appended claims.

What is claimed is:

1. In a method of continuously casting molten aluminum and hot forming said cast metal in substantially its as-cast condition at a hot-forming temperature by a plurality of substantial compressions, the improvement comprising the steps of:

following casting of said metal and prior to said substantial compression of said metal, forming a substantially uniform subgrain structure at least at the surface of said metal by at least one preliminary light compression of said metal wherein said metal is selected from the group consisting of aluminum and aluminum alloys.

2. The method of claim 1 wherein said preliminary light compression reduces the cross-section of said metal by between 5 and 25%.

3. The method of claim 1, wherein said substantial compressions following the forming of said substantially uniform subgrain structure includes a first compression providing at least 30% reduction of the cross-section of said metal.

4. The method of claim 1 wherein said light compressions comprise a first 7% reduction of the cross-section of said metal followed by a second 7% reduction along an axis of compression 90° removed from said first 7% reduction.

5. The method of claim 1 wherein said light compressions comprise a first 7% reduction of the cross-section of said metal followed by at least one additional 7% reduction along an axis of compression 60° removed from the axis of said immediately prior 7% reduction.

6. The method of claim 1, wherein the total of said light compressions results in less than a 30% reduction of the cross-section of said metal.

7. The method of claim 1 wherein said metal is a 2000 series aluminum alloy.

8. The method of claim 1 wherein said metal is a 7000 series aluminum alloy.

9. The method of claim 1 wherein said metal is a 6000 series aluminum alloy.

10. The method of claim 1 wherein said metal is a 5000 series aluminum alloy.

11. The method of claim 7 wherein said metal is 2024 aluminum alloy.

12. The method of claim 7 wherein said metal is 2117 aluminum alloy.

13. The method of claim 8 wherein said metal is 7075 aluminum alloy.

14. The method of claim 8 wherein said metal is 7079 aluminum alloy.

15. The method of claim 9 wherein said metal is 6061 aluminum alloy.

16. The method of claim 9 wherein said metal is 6101 aluminum alloy.

17. The method of claim 9 wherein said metal is 6201 aluminum alloy.

18. The method of claim 10 wherein said metal is 5052 aluminum alloy.

19. The method of claim 10 wherein said metal is 5056 aluminum alloy.

20. A method of hot forming a continuously cast aluminum bar without cracking said bar comprising the steps of:

passing said bar in substantially its as-cast condition and at a hot-forming temperature from a continuous casting machine to a hot-forming means;

conditioning said bar for subsequent hot forming by forming a substantially uniform subgrain structure at least at the surface of said bar by a plurality of preliminary light sequential compressions of said bar each reducing the cross-section of said bar by from 5% to 25% each and a total reduction of less than 30%;

hot forming said bar by a single compression of said bar to reduce its cross-sectional area by at least 40%; and hot forming said bar by a plurality of sequential compressions in each of which the cross-section of said bar is changed to the extend necessary to provide a hot-formed product having a predetermined cross-section.

21. The method of claim 20 wherein said conditioning of said bar includes passing said bar between rolls in a plurality of sequential roll stands.

22. The method of claim 21 wherein said hot forming of said bar includes passing said bar through sequential roll stands of a rolling mill.

* * * * *